United States Patent [19]

Caporiccio et al.

[11] Patent Number: 4,472,290

[45] Date of Patent: Sep. 18, 1984

[54] PROCESS FOR PREPARING LUBRICATING GREASES BASED ON POLYTETRAFLUOROETHYLENE AND PERFLUOROPOLYETHERS

[75] Inventors: Gerardo Caporiccio; Silverio Soldini, both of Milan; Ezio Strepparola, Treviglio, all of Italy

[73] Assignee: Montedison S.p.A., Milan, Italy

[21] Appl. No.: 432,839

[22] Filed: Oct. 5, 1982

[30] Foreign Application Priority Data

May 31, 1982 [IT] Italy ..... 21590 A/82

[51] Int. Cl.[3] ..... C10M 5/20; C10M 5/24; C10M 5/28

[52] U.S. Cl. ..... 252/51.5 R; 252/49.9; 252/58

[58] Field of Search ..... 252/51.5 R, 58, 49.9

[56] References Cited

U.S. PATENT DOCUMENTS

| | | | |
|---|---|---|---|
| 3,723,317 | 3/1973 | Ulery | 252/58 |
| 3,784,471 | 1/1974 | Kaiser | 252/58 |
| 4,011,267 | 3/1977 | Tamborski et al. | 252/49.9 |
| 4,194,983 | 3/1980 | Paciorek et al. | 252/49.9 |

*Primary Examiner*—Jacqueline V. Howard

[57] ABSTRACT

A lubricating grease consisting of a mixture containing from 15% to 40% by weight of polytetrafluoroethylene, from 60% to 85% by weight of a liquid dispersing medium of the type of perfluoropolyether or oligomer of $C_2ClF_3$, less than 1% by weight of a perfluoroalkyl or polyoxyperfluoroalkyl surfactant and, optionally, stabilizing and anticorrosive agents of the class of polyoxyperfluoroderivatives, said mixture being subjected to grinding in order to obtain the disaggregation of the polytetrafluoroethylene granules into primary particles not larger than 1 micron.

6 Claims, No Drawings

PROCESS FOR PREPARING LUBRICATING GREASES BASED ON POLYTETRAFLUOROETHYLENE AND PERFLUOROPOLYETHERS

BACKGROUND OF THE INVENTION

This invention relates to an improved process for preparing lubricating greases based on polytetrafluoroethylene and perfluoropolyethers.

As is known, the most common and general method of preparing greases consists in suspending a thickening filler in a liquid or waxy dispersing medium.

In particular, when the thickening filler does not consist of a soap (such as for example the derivatives of lithium, sodium, calcium, of fatty acids), or at any rate of a compound capable of forming a colloidal solution or a suspension stable in the dispersing liquid, the grease tends to show a lack of stability with the passing of time and to lose its original lubricating properties as well as, at limit, to suffer a separating of the oil during the ageing (separation of oil as defined by the IP 121/75 and FTMS 791 standards), with the ensuing decay of the rheological and tribological properties.

It is known that a fluorinated grease may be formulated (see for example J. Messina, J. Am. Soc. of Lubr. Eng. (December 1969) 475–481, and Italian Pat. No. 963,579) by suspending a polytetrafluoroethylene telomer having an average molecular weight of 20,000–30,000 and partially chlorinated chain terminals (as a result of the radicalic polymerization method in suspension of 1,1,2-trichlorotrifluoroethane) in a perfluorinated liquid, such as for example the perfluoropolyethers described in Italian Pat. Nos. 792,673 and 790,651.

The abovesaid perfluoropolyethers have the commercial name Fomblin Y and the general formula $$X—O—(C_3F_6O)_m(CF_2O)_n—Y \quad (I)$$

and respectively Fomblin Z having the general formula $$A—O—(C_2F_4O)_p(CF_2O)_q—B \quad (II)$$

in which the oxyperfluoroalkylene units are statistically distributed along the chain, where X and Y in formula (I) are a terminal group $—CF_3$ or $—C_2F_5$, m and n are integers, the sum of which ranges from 10 to 100 and the m/n ratio ranges from 10 to 50; terminal groups A and B in formula (II) are selected from the group including $—CF_3$, $—C_2F_5$, $—CF_2Cl$, $—CF_2CF_2Cl$, p and q are integers, the sum of which ranges from 10 to 200 and the p/q ratio has a value of from 0.1 to 10.

Useful for the same utilization are also the perfluoropolyethers of general formula $$A—O—(C_2F_4O)_r(CF_2O)_s(C_tF_{2t}O)_u—B \quad (III)$$

wherein terminal groups A and B are the same as in formula (II); t is an integer higher than or equal to 3, r, s, u are integers the sum of which ranges from 10 to 3000 and the $$\frac{u}{r+s}$$

ratio has a value ranging from 0.01 to 0.3 and the r/s ratio has a value ranging from 0.1 to 10.

The products of formula (III) may be obtained by reacting a perfluorinated olefin on a perfluoropolyether containing peroxide groups, in the presence of U.V. radiations.

These products and the preparation thereof are described in Italian patent application No. 20270 A/82 filed by the Applicant.

The polytetrafluoroethylene telomer defined hereinbefore is usually obtained as a 7% suspension in 1,1,2-trichlorotrifluoroethane in which the average diameter of the particles of telomer is lower than 30 microns.

The known formulation method consisted in gradually adding the perfluoropolyether to the 7% polytetrafluoroethylene suspension, or to the partially concentrated suspension at 50–60%, by simultaneously evaporating the solvent under vacuum.

The resulting grease exhibits good lubricating properties. The process, however, is very long and complex. In particular, the preparation of an amount of about 30 kg of grease involves the mixing of a volume up to about 50 liters of telomer suspension with the dispersing liquid; it is therefore necessary to evaporate from the mixture up to about 45 liters of solvent, which, since it is miscible in perfluoropolyether, tends to leave in the final grease a small amount of a non-evaporable residue which is harmful as regards both the stability of the grease and the evaporation at high temperature or under vacuum.

Usually, the solvent evaporation step took from 20 to 45 hours.

Furthermore it is not possible to excessively increase the scale of each preparation owing to the difficulty due to the heat and mass exchange in too great volumes. Moreover, both the high-temperature evaporating properties and the heat stability properties of the grease are jeopardized by the relatively low thermal stability of the telomer, owing to the presence of chlorinated chain terminal groups. It is known in fact that the C—Cl bond is less stable than the C—F bond.

The thermal stability of the telomer is lower than the one of the Fomblin liquid: by consequence the improved thermal resistance properties obtained by employing Fomblin instead of other suspending fluids get partially lost.

So far it was an acquired fact that the best performances of a polytetrafluoroethylene as a thickening agent for a liquid in order to provede a grease corresponded to the described telomer (Journal ASLE 1969, 12, page 475, J. Messina).

THE PRESENT INVENTION

The present invention relates to a new type of lubricating grease in which, as an essential ingredient, polytetrafluoroethylene having a molecular weight not below 50,000 and a high thermal stability is employed in the form of particles in suspension in a perfluorinated liquid of the type of the oligomers of trifluorochloroethylene having a viscosity ranging from 100 to 1,000 cst at 20° C.

It is known how to obtain, by polymerization of tetrafluoroethylene in an aqueous dispersion with use of ammonium persulphate and Mohr salt, a polymer having a molecular weight ranging from 500,000 to 1,000,000. The particles of said polymer, after separation from the dispersing medium, turned out to consist of aggregates with sizes ranging from 1 to 200 microns, such aggregates consisting of primary particles with sizes ranging from 0.05 to 0.5 microns, which have either a spherical shape or the shape of a rounded rod with the major axis below 0.5 microns.

The particles have a surface area of from 5 to 15 $m^2/g$.

It has now been found that it is possible to attain the disaggregation of the aggregated particles of polytetrafluoroethylene into primary particles having sizes ranging from 0.05 to 0.5 microns of rounded or spherical shape, when the aggregated particles are soaked or suspended in a perfluorinated liquid selected from: perfluoropolyether of the Fomblin Y type of formula (I) having a kinematic viscosity of from 20 to 4000 cst at 20° C., preferably from 40to 1600 cst at 20° C., or of the Fomblin 2 type of formula (II) having a viscosity of from 40 to 6000 cst at 20° C., preferably from 60 to 6000 cst at 20° C., or a perfluoropolyether of formula (III) having a kinematic viscosity of from 40 to 30,000 cst at 20° C., preferably from 60 to 28,000 cst, or an oligomer of trifluorochloroethylene having a kinematic viscosity of from 100 to 1000 cst, and then said aggregated particles of polytetrafluoroethylene suspended in the Fomblin liquid are subjected to a grinding or disaggregating process in a refiner, thus directly obtaining the grease endowed with the final rheological and mechanical properties as desired.

In particular, the soaking and suspending process of the polytetrafluoroethylene particles of the aggregated type having sizes above 1 micron and up to 200 microns, and consisting of aggregations of spherical or rounded rod-like particles of submicronic sizes, is accomplished as follows:

(1) The inner voids of the polytetrafluoroethylene particles must be evacuated from air and condensed vapors (e.g. water vapors) by means of heating for about 2 hours at 50° C. under a vacuum of the order of $10^{-1}$–$10^{-3}$ torr.

(2) The particles so treated are subjected to a soaking and suspending treatment, at a temperature higher than the room temperature and under reduced pressure, with a perfluoropolyether liquid such as Fomblin Y or Z or of formula (III), or with an oligomer of $CF_2CFCl$ as defined hereinbefore, which has previously been deaerated. The perfluoropolyethereal liquid possesses a high air-solubilizing power, up to 20% by volume at 20° C. and at atmospheric pressure.

Polytetrafluoroethylene is employed in amounts of from 15 to 40% by weight, preferably of from 18 to 35% by weight, calculated on the total mix.

(3) The perfluoropolyether fluid or the oligomer of $CF_2CFCl$ used in amounts of from 60 to 85% by weight referred to the total mix, preferably from 65 to 82% by weight, is additioned with a perfluorinated surface-active agent of the anionic type having a perfluoroalkylene chain, of general formula $$CF_3—(CF_2)_n—D \quad (a)$$

wherein n is an integer comprised between 2 and 12, preferably between 3 and 8, and D is selected from the group including —COOM, $—SO_3M$ and $—OC_2F_4SO_3M$ where M is a cation selected from Na, K, ½Ba, ½Ca, or with a surface-active agent of the polyoxyperfluorinated anionic type having general formula $$R—O—(C_3F_6O)_i(C_2F_4O)_k(CF_2O)_h—Q \quad (b)$$

wherein R is either like or unlike Q and is selected from $CF_3$— and $MOCOCF_2$— in which M is a cation as defined hereinabove; Q is a group $—CF_2COOM$ where M is a cation as defined hereinabove, provided that when R is equal to Q, index i is equal to zero; oxyperfluoroalkylene units $C_2F_4O$, $C_3F_6O$ and $CF_2O$ are statistically distributed along the chain, provided that the $C_3F_6O$ and $C_2F_4O$ units are not present contemporaneously; i and k are equal to zero or are integers ranging from 1 to 7, preferably from 1 to 4, h is an integer from 1 to 7, the sum of i, k and h being a number ranging from 2 to 10, preferably from 2 to 6. The surface-active agent is employed in amounts of from 0.1% to 0.4%, preferably from 0.2 to 0.3% by weight in respect of the polytetrafluoroethylene powder.

Some examples of surface-active agents which have provided excellent results are the following:

$CF_3—(CF_2)_6—COONa$ $CF_3—(CF_2)_6—COOK$ $(CF_3—(CF_2)_5COO)_2Ca$ $(CF_3—(CF_2)_7COO)_2Ba$ $CF_3—(CF_2)_6—SO_3K$ $CF_3—(CF_2)_5SO_3Na$ $CF_3—(CF_2)_7SO_3K$ $CF_3—(CF_2)_3—O—CF_2—CF_2—SO_3K$ $CF_3—(CF_2)_5—O—CF_2—CF_2SO_3K$ $$CF_3O—(CF_2—\underset{\underset{CF_3}{|}}{CF}—O)_2—CF_2O—CF_2—COONa$$

$$CF_3O—CF_2—\underset{\underset{CF_3}{|}}{CF}—O—CF_2O—CF_2—COOK$$

$NaOOC—CF_2O—(C_2F_4O)_2(CF_2O)_2—CF_2COONa.$

The soaking of polytetrafluoroethylene of the described type with perfluoropolyether liquid leads to a very viscous pasty suspension. Such suspension is subjected to disaggregation or grinding of the aggregated particles into primary particles by treatment in a refiner such as a triple roll mill, for example of the type manufactured by Officine Meccaniche Molteni, Italy.

Such machine consists of three parallel rolls cooled by inside circulation of water and adjustable as to revolving speed and gap between the rolls; the adjacent rolls revolve in opposite directions to each other and at different speeds; furthermore they may be put into contact with each other so as to exert a squashing pressure, while the pressure exerted on the suspension of polytetrafluoroethylene in perfluoropolyether may be hydraulically regulated between 1 and 50 atmospheres by a control servofluid.

The suspension shall be introduced between the first roll revolving at low speed and the second roll which revolves at middle speed, and is then extracted after having passed between the second roll and the third roll, which revolves at a higher speed.

It has been found that under the best operational conditions it is necessary that the hydraulic control pressure of the servofluid be comprised between 10 and 75 atmospheres, preferably between 15 and 65 atmospheres, that the speed of the first roll be comprised between 20 and 50 rpm, the speed of the second roll between 60 and 140 rpm, the speed of the third roll between 150 and 400 rpm.

In particular, the action of total disaggregation of the particles aggregated to primary particles having a spherical shape or the shape of a rounded rod is obtained when the particles of polytetrafluoroethylene powder are fully degassed and the perfluoropolyether liquid has completely wetted all the voids and the gaps formed among the primary particles in the inside of the aggregated particles.

The action of full wetting and soaking of the polytetrafluoroethylene particles having a surface tension of 19–22 dynes/cm, is made possible by the low value (17.5–21 dynes/cm) of the surface tension of perfluoropolyether.

The squashing pressure between the cylinders is hydraulically transmitted homogeneously through the suspension, without formation of any air bubbles due to coalescence among microbubbles, the forming of which could detach the liquid film adhering to the particles or to the rolls, thereby causing sintering phenomena among the particles with formation of new irregular and fibrous aggregates and breaking phenomena of the primary particles.

The particles disaggregate owing to the friction among one another and with the perfluoropolyether fluid threads adhering to the walls of the revolving rolls or to the other particles.

In order to obtain a disaggregation of the aggregated particles to primary particles without causing a microrupture of the primary particles or the reaggregation or sintering of the particles into fibrous or irregular aggregates, it is necessary to prevent the unwetted particles from coming directly into contact with one another or with the unwetted rolls.

The duration of the adherence of the liquid film to the particles and to the rolls depends, besides on the absence of gases and vapors in the suspension, on the mechanical resistance characteristics of the fluid film adhering to the particles and to the rolls.

The stabilities of the grease, namely the adherence duration and the mechanical resistance of the liquid adhering to the particles, is improved by the presence of suitable agents endowed with surface activity which probably act as wetting agents thus increasing the adhesion of the liquid film to the surface.

Such resistance depends besides on the surface tension also on the molecular weight and by consequence on the viscosity of the fluid and on the chemical structure thereof.

The perfluoropolyether fluids possess a high mechanical resistance, as is proved by measurements with the 4-ball Shell test under EP conditions (test IP 239, where welding load values ranging from 400 to 500 kg, corresponding to values higher than the average values of the other additioned fluids, are measured).

On the other hand it may be ascertained how, by using a fluorinated fluid, characterized by a low surface tension (19 dynes/cm) and by a low molecular weight such as 1,1,2-trichlorotrifluoroethane, as a suspending liquid for the soaking and the disaggregation of polytetrafluoroethylene, it is impossible to get a homogeneous disaggregation of the polytetrafluoroethylene powder into primary particles. In fact such liquid does not possess sufficient viscosity and mechanical resistance properties to bring about the protecting action on the particles and to avoid the aggregation and sintering thereof to fibrous particles.

To obtain the desired protecting action, the perfluoropolyether or the $CF_2CFCl$ oligomer must possess a viscosity higher than 30 cs at 20° C., as already mentioned hereinbefore.

Furthermore, the mechanical stability of the grease, its wear resistance also when it operates under great loads, its capability of imparting corrosion resistance to the materials on which it is applied, are enhanced by the presence of proper additives such as fluorinated bis-benzimidazoles having the structure:

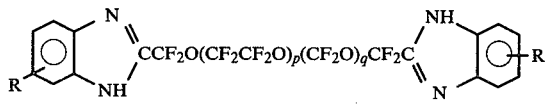

wherein R may be F, $CF_3$, the sum $p+q=10–100$, the $p/q$ ratio $=0.1–2$; or such as the esters of phosphorous ester $$[CF_3O(CF_2-\underset{\underset{CF_3}{|}}{CFO})_3-CF_2CH_2O]_3P$$

or the phosphines such as $$[CF_3O(CF_2-\underset{\underset{CF_3}{|}}{CFO})_3-CF_2CH_2OCH_2C_6H_4]_3P$$

wherein $C_6H_4$ is a disubstituted phenyl residue which is bound to trivalent phosphorus. Suitable are also perfluoropolyethers having, at both ends, aryl-substituted phosphonic groups, or phospotriazinic groups

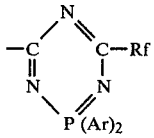

where Rf is a perfluoroalkyl radical or a polyoxyperfluoroalkyl radical, and Ar is an aryl radical.

If the fluids are additioned by 0.2–1% by weight of the wear-resisting and corrosion-resisting additives specified hereinabove, their mechanical resistance is improved to such extent, that the welding load with the 4-ball Shell test rises to values of 600–800 kg; furthermore, the corrosion resistance of the metal lubricated and subjected to oxidizing atmosphere conditions improves too.

The tests which permit to ascertain the obtainement of a grease having satisfactory physical, mechanical, rheological and wear-resisting properties are:

the examination under the optical microscope to ascertain the disappearance of the aggregates and the absence of fibrous aggregates;

the examination under the electron microscope to determine both the shape and the particle size distribution of the primary particles;

the consistency of the grease determined through penetration measurements according to test ASTM D 1403 on the grease as such, handling after the Roll test (ASTM D 1831, at 100° C.);

percent separation of oil at 100° C. (method FTMS 791-321) or at 40° C. under load (method IP 121/75);

mean diameter of the trace left by the wear and wear load under the 4 -ball Shell apparatus (tests ASTM D 2266, IP 239);

loss of oil under evaporation and vapor tension at different temperatures (Knudsen method).

Important fields of applications for the grease are the following:

lubrication under high loads and under severe chemical and physical conditions where high mechanical, thermal and chemical resistances are required;

vacuum, where a high stability to evaporation, i.e. an extremely low vapor tension and a high lubricating power are required;

where a high resistance to electromagnetic radiations, ($\gamma$, X, ultraviolet and Laser rays) and to accelerated particles (electrons, protons and ions) is required.

Such applications are possible thanks to the combination of perfluoropolyether and polytetrafluoroethylene, in which the little stable C—CL and C—H bonds are either absent or extremely few and the C—O and C—F bonds are absolutely predominant.

The following examples are given to illustrate the present invention, without being however a limitation thereof.

EXAMPLE 1

7 kg of crystalline polytetrafluoroethylene having a molecular weight of about 600,000, prepared by polymerization in an aqueous dispersion at 60° C. and 20 atm. by means of ammonium persulphate and Mohr salt, consisting of aggregated particles having diameters ranging from 1 to 100 microns as determined under an optical microscope, were introduced into a mechanical mixer equipped with Z-shaped arms, a mechanical seal cover with connection for the vacuum and for the introduction of liquids as well as for the under vacuum removal of gases and vapors, and with a thermoregulation jacket.

The jacket was thermoregulated at a temperature of 50° C. while the vacuum-connection of the mixer was connected with a mechanical vacuum pump, whereupon vacuum was created up to a residual pressure of $5.10^{-2}$ torr, and such vacuum was maintained for 3 hours. Into a cylindrical steel tank having a capacity of 20 l, resisting to vacuum and equipped with connection for the vacuum and with a heating jacket, there were introduced 16.4 kg (8.1 l) of perfluoropolyethereal oil Fomblin Y produced by Montedison S.p.A., having a kinematic viscosity of 1500 cs (at 20° C.), and additioned with 14 kg of a surfactant having the formula $CF_3(CF_2)_6COONa$. The oil was heated at 50° C. and the tank was connected with the mechanical vacuum pump, thus creating in the tank inside a vacuum corresponding to a final residual pressure of $5.10^{-2}$ torr for 3 hours.

In this way the polytetrafluoroethylene powder and the Fomblin oil were completely freed from gases and volatile vapours.

Successively the arms of the mixer were put into a rotational motion and, by gravity, the Fomblin liquid was gradually introduced, over a time-period of 30 minutes, into the mixer. Then, heating of the mixer jacket was stopped while going on stirring the mass for 3 hours until complete cooling to 20° C.: at the end a pasty suspension was obtained.

On a suspension sample, on a Brookfield rotary viscosimeter, a viscosity of 185,000 cp at 20° C. was determined.

The suspension was discharged from the mixer and subjected to thickening in a refiner equipped with three rolls of 180 mm diameter, the roll length being of 400 mm, by causing the suspension to pass between the rolls revolving at a speed of 40 rpm and of 70 rpm, and then by collecting it through detachment from the surface of the third roll revolving at 150 rpm.

The rolls were kept in contact by means of a pressure of the survofluid of about 60 atm.

The 23.4 kg of pasty suspension were made to pass between the three rolls in a time-period of 2 hours.

A film consisting of grease thus formed, which was continuously detached from the third roll by means of a steel scraping blade. A grease sample was drawn and the consistency thereof was measured by a penetration determination according to the ASTM D 1403 method (½ scale) at a temperature of 25° C.

A value of 245 (mm/10) was found.

The grease was made to pass other four times between the rolls kept at the same speed and at the same distance from one another, thus obtaining, in the order, the following penetration values as a consistency measure:

after the 1st run: 245 mm/10 of penetration
after the 2nd run: 242 mm/10 of penetration
after the 3rd run: 240 mm/10 of penetration
after the 4th run: 240 mm/10 of penetration.

The succession of values shows that on the 4th passage a mechanically stable grease was obtained.

A sample of the grease was placed into the cup of the penetration measuring apparatus (ASTM D 1403 test) and was subjected to a manual handling, the so-called 60-stroke working; the grease so treated exhibited a penetration of 241 (mm/10).

A grease sample subjected to the 10,000-stroke mechanical test exhibited a penetration, according to ASTM D 1403, of 250 (mm/10), which indicated a high mechanical stability. On the basis of such penetration values, this grease may be classified at the 3rd degree of consistency according to the classification ot the National Lubricating Grease Institute (NLGI). On a sample of the grease, the thickening agent was recovered by means of repeated washings with 1,1,2-trichlorotrifluoroethane and by decantation in order to remove the Fomblin oil. The solid polytetrafluoroethylene, examined under the optical microscope, did not reveal particles having sizes greater than one micron.

The powder thus recovered was examined under the electron microscope in order to determine both shape and granulometric distribution of the primary particles.

The diameters of the particles varied from 0.13 microns (2% fraction) to 0.35 microns (0.5% fraction), the average diameter value being of 0.19 microns.

The contour of the particles was round-shaped.

Samples of grease were subjected to the measurements listed hereinbelow:

Oil separation, IP 121/75 method (40° C., 168 hours): +3.9%

Oil separation, FTMS 791-321 method (100° C., 30 hours): +5%

Consistency (ASTM D 1403, ½ scale, at 25° C.) after Roll test (ASTM D 1831, at 100° C.):
penetration after 4 hours: +0.5% variation
penetration after 8 hours: +3.8% variation Diameter of the trace left by wear on the 4-ball Shell machine (ASTM D 2266):
average $\phi$ of the trace left by wear at 50° C.: 1.45 mm
average $\phi$ of the trace left by wear at 120° C.: 1.55 mm Wearing load on the 4-ball Shell machine (IP 239 method, spindle speed=1460 rpm): 580 kg Evaporation (ASTM D 972): weight loss at 149° C. after 22 hours: 0.01%

Vapor tension (at 20° C.): $2.10^{-12}$

Pour point temperature: −30° C.

In order to establish the sealing properties of the grease under high vacuum and at low temperature, the following test was carried out.

Onto a Pyrex Schott glass flask (A) of 1 l capacity, having a ground-glass conical neck with an inner diameter of 26 mm, a vacuum cock (B) with a double ground-glass cone having an outer diameter of 26 mm was mounted, and on this cock a 3-way coupling (C) with a ground-glass cone of 26 mm inner diameter was fitted for connection with cock (B), as well as a ground-glass cone of 12 mm diameter to which a ionization vacuum feeler and a vacuum cock (D) were connected, the latter being connected with a vacuum system equipped with a vacuum diffusion pump. The volume comprised between cocks B and D was of 50 $cm^3$.

All ground-glass surfaces were lubricated with the grease prepared according to example 1, the apparatus was mounted, cocks B and C were kept open, and the whole was connected with the vacuum system; after 30 minutes, a vacuum corresponding to a residual pressure in the system A-B of $2.10^{-8}$ torr, as read on a gauge inserted in C, was attained.

Vacuum cock D was closed and after 24 hours it was checked to ascertain that the vacuum in system A-B had not changed. Vacuum cock B was closed and disconnected from C, section A-B was placed into a freezer regulated at −25° C., keeping it there for 24 hours.

After this period, section A-B was removed from the freezer, and flask A was manually rotated 20 times with respect to coupling B in a total time of 5 minutes, leaving cock B closed.

Coupling C was then connected with B and vacuum was created again in connection B-C without opening cock D, until a final residual pressure of $2.10^{-8}$ torr was attained.

Cock D was closed in order to cut off the suction to the pump, cock B was opened and it was ascertained that the pressure in system A-B was of $3.10^{-8}$ torr.

Such test proved the perfect sealing power of the grease when used to lubricate vacuum flanges, even after slipping of the sealing surfaces at a low temperature of −25° C.

The test was repeated, but using a commercial grease based on polytetrafluoroethylene and mineral wax having a softening point of 45°–47° C.; after freezing of system A-B in the freezer at −25° C. for 24 hours, flask A could not be rotated with respect to coupling B.

A grease sample was subjected to a resistance test to aviation fuel oil, according to MIL G 27617 standard (fuel oil according to ML S 3136 standard), by determining the solubility in fuel oil after stirring of the grease in fuel oil for 30 minutes at 25° C., and the resistance of the grease smeared on aluminium strips immersed in fuel oil for 8 hours at 70° C.

It was thus ascertained that the grease was insoluble in fuel oil and protected the metal strip from any corrosive action or any alteration.

COMPARATIVE EXAMPLE 1

The same apparatus described in example 1 was used. 7 kg of polytetrafluoroethylene in powder of the same quality and with the same characteristics of the product described in example 1 were introduced into the previously described mixer equipped with Z-shaped arms.

Onto the powder there were poured, in 30 minutes, 8.6 l of Fomblin Y liquid having a kinematic viscosity of 1500 cs at 20° C. and additioned with a surfactant of formula $CF_3(CF_2)_6COONa$ heated to a temperature of 50° C.; the whole was stirred for further 3 hours, whereupon it was allowed to cool down spontaneously. A pasty suspension was obtained which, at the Bookfield rotary viscosimeter, exhibited a viscosity of 100,000 cp at 20° C. This suspension was conveyed to processing in the triple roll mill described in example 1 and was subjected to four runs, the pressure between the rolls being adjusted to 30 atm.; each run lasted 2 hours, till a stationary y consistency was attained. The penetration degrees attained (ASTM D 1403, ½ scale, at 25° C.) were as follows:

after the 1st run: 288 (mm/10)
after the 2nd run: 285 (mm/10)
after the 3rd run: 284 (mm/10)
after the 4th run: 284 (mm/10).

On the grease manually handled with 60 strokes, a penetration of 310 (mm/10) was found, while on the grease mechanically treated, a penetration of 340 (mm/10) was determined after 10,000 strokes, which revealed a low mechanical stability.

These penetration values put the grease in the 1–2 degree of consistency according to the NLGI classification.

Sample of this grease were subjected to the following measurements:

Oil separation, method IP 121/75: (40° C., 168 hours): 6.5%

Oil separation, method FTMS 791-321: (100° C., 30 hours): 9.5%

Consistency (ASTM D 1403, ½ scale, 25° C.) after the Roll test (ASTM D 1831, 100° C.):
penetration after 4 hours: +4% variation
penetration after 8 hours: +9% variation Diameter of the traces left by wear tested on the 4-ball Shell machine (ASTM D 2266):
mean $\phi$ of the trace left by wear at 50° C.: 2.5 mm
mean $\phi$ of the trace left by wear at 120° C.: 2.8 mm The obtained data, when compared with those of the grease of example 1, show the importance of the removal of air from the voids of the polytetrafluoroethylene powder and of the degassing of Fomblin with a view to ensuring good rheological properties as well as a high intrinsic and mechanical stability of the grease.

COMPARATIVE EXAMPLE 2

The same apparatus as described in example 1 was used. 7 kg of polytetrafluoroethylene of the same quality and characteristics of the product described in example 1 were introduced into the mixer equipped with Z-shaped arms and were degassed under a vacuum of $5.10^{-2}$ torr.

8.6 l of trichlorotrifluoroethane ($CF_2Cl—CFCl_2$), degassed from the air at incipient boiling temperature (47° C.), were then added, maintaining the mass under stirring inside the arm-mixer. Stirring was carried on for further 3 hours, until the mass had cooled down to 20° C.

The suspension was treated on the triple roll mill for 4 hours, and 4 runs were carried out in succession, each run having a duration of 4 hours, as described in example 1.

A suspension was thus obtained and the solvent floating on the polytetrafluoroethylene powder was separated.

In a sample of such suspension, examined under the optical microscope, the particles appeared to be organized in irregularly shaped aggregates of the dendritic type, with particle sizes ranging from 0.5–1 to 100–200 microns, which indicates an irregular grinding effect and a re-aggregation of the starting powder. The suspension was put again into the Z-arm-mixer and was maintained under stirring, while the jacket was thermoregulated at 50° C. From the 20-liter tank containing 8.6 l of Fomblin having a viscosity of 1500 cs (20° C.) and additioned with a surfactant of formula $CF_3(CF_2)_6COONa$, Fomblin was introduced into the mixer in a time-period of 4 hours, while most of the trichlorotrifluoroethane solvent was simultaneously distilled.

Stirring was continued for further 3 hours at 50° C., keeping the mass under a vacuum of 50 torr and lastly of 0.1 torr, finally allowing the mass to gradually cool down under stirring. A grease having a fibrous appearance was obtained, which was conveyed to the triple roll mill, there it was subjected to 4 runs, each run lasting 2 hours.

A grease having a fibrous appearance was obtained again, which exhibited a penetration (ASTM D 1403) of 200 (mm/10), which, after a manual 60-stroke working, passed to 220 (mm/10) and, after a mechanical 10,000 stroke processing to 275 (mm/10). Samples of the grease were subjected to the following measurements:

Oil separation, method IP 121/75: (40° C., 168 hours): 9%

Oil separation, method FTMS 791-321: (100° C., 30 hours)

Consistency (ASTM D 1403, ½ scale, 25° C.) after the Roll test (ASTM D 1831, 100° C.):
penetration after 4 hours: +7% variation
penetration after 8 hours: +8% variation Diameter of the traces left by wear on the 4-ball Shell machine (ASTM D 2266):
mean $\phi$ at 50° C.: 2.3 mm
mean $\phi$ at 120° C.: 3.5 mm Evaporation (ASTM D 972) at 149° C., 22 hours: −2%.

The properties reported hereinabove show that the grease prepared according to comparative example 2 possessed neither satisfactory properties of intrinsic and mechanical stability, nor satisfactory rheological properties as compared to those of the grease prepared according to example 1.

That is ascribable to the inadequate suspending and protective action of 1,1,2-trichlorotrifluoroethane during the grinding and disaggregation process of polytetrafluoroethylene.

The worse stability to evaporation of the grease at 149° C. is ascribable to the persistance of trichlorotrifluoroethane in the grease after formulation.

EXAMPLE 2

The same apparatus as described in example 1 was used. 7 kg of polytetrafluoroethylene of the same type as the one described hereinbefore were introduced into the mixer, were degassed at 50° C. under a vacuum of $5.10^{-2}$ torr and additioned with 9 liters of perfluorinated polyether Fomblin Z having a viscosity of 250 cs (at 20° C.) and additioned with 14 kg of a surfactant of formula:

$$NaOOC—CF_2O(C_2F_4O)_2(CF_2O)_2CF_2—COONa$$

previously deaerated at 50° C. under a vacuum of $4.10^{-5}$ torr. The suspension was homogenized by stirring for 3 hours while the temperature was allowed to drop to 20° C.; a pasty suspension was thus obtained, which was worked on the triple roll mill by passing it 4 times between the rolls, each run taking 2 hours, the rolls being maintained in contact with one another under a servofluid pressure of 30 atm.

After each run, the following penetration values (ASTM D 1403, ½ scale) were obtained:
after the 1st run: 240 mm/10
after the 2nd run: 235 mm/10
after the 3rd run: 231 mm/10
after the 4th run: 231 mm/10.

On a sample of this grease, after a mechanical 10,000-stroke working, a penetration of 235 (mm/10), corresponding to a high mechanical stability, was measured.

On a grease sample, after separation of the oil by means of 1,1,2-trifluorotrichloroethane, the particles of the thickening polytetrafluoroethylene were examined under a transmission electron microscope, whereby a particle size distribuzion ranging from 0.1 to 0.4 microns was determined. The shape of the particles appeared rounded. Samples of this grease were subjected to the measurements listed hereinbelow:

Oil separation, method FTMS 791-321 (100° C., 30 hours): 5%

Consistency (ASTM D 1403, ½ scale, 25° C.) after the Roll test (ASTM D 1831, 100° C.):
penetration after 4 hours: +1%
penetration after 8 hours: +4.1%

Diameter ($\phi$) of the trace left by wear on the 4-ball Shell machine (ASTM D 2266):
mean $\phi$ of the trace left by wear at 50° C.: 1.6 mm
mean $\phi$ of the trace left by wear at 120° C.: 1.7 mm Wear load on the 4-ball Shell machine (IP 239 method, spindle speed=1460 rpm: 600 kg Evaporation (ASTM D 972): weight loss at 149° C. after 22 hours: 0.01%.

A 100-gram sample of grease was used to fill the lubrication reserve of the ball bearings of a reaction turbine which was driven by carbon tetrachloride vapours.

Balls and housing of the bearings were made of AISI 316 steel, the bearing diameter was of 30 mm, the speed of rotation of the turbine was of 12,000 rpm.

After a 30-day running of the turbine, the lubrication reserve tank contained still more than 50% of the starting grease. The bearings were removed and their perfect brightness, lack of corrosion and of wear were ascertained.

EXAMPLE 3

The same apparatus as described in example 1 and the same preparation procedures were employed.

A grease was formulated starting from 7 kg of polytetrafluoroethylene of the same type as described hereinbefore and from 9.5 l of fluorinated polyether Fomblin Y having a viscosity of 40 cs (20° C.) and additioned with 14 g of a surfactant of formula $CF_3—(CF_2)_3OC_2F_4SO_3K$.

After mixing in the Z-shaped-arm mixer, the resulting pasty suspension was conveyed to the triple roll mill where, after the third run, a grease having a penetration of 250 mm/10 (ASTM D 1403, ½ scale) was obtained.

After a mechanical 10,000-stroke working, the penetration was of 270 mm/10, which indicated a high mechanical stability. The oil separation (FTMS 791-321) at 66° C. after 30 hours was of 6%.

The mean diameter of the trace left by wear at 50° C. on the 4-ball Shell machine (ASTM D 2266) was equal to 2.1 mm.

EXAMPLE 4

The same apparatus as described in example 1 and the same preparation modalities were employed.

A grease was formulated starting from 6.5 kg of a polytetrafluoroethylene of the type described hereinbefore and from 9.5 l of fluorinated polyether of formula $$CF_3O(C_tF_{2t}O)_u(C_2F_4O)_r(CF_2O)_s—CF_3$$

wherein the sum $u+r+s=3000$, $u/r+s=0.01$, $r/s=0.7$, $t\geqq 3$; the viscosity of the polyether was of 29,500 cs/20° C.

This perfluoropolyether was prepared according to the process described in Italian patent application No. 20270 A/82.

There were additioned 14 g of a surfactant of formula $NaOOCCF_2O\ (C_2F_4O)_2(C_2F_4O)_2(CF_2O)_2CF_2COONa$ and 14 g of benzimidazole of formula

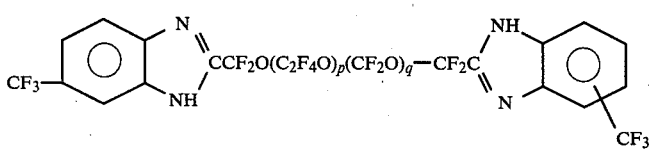

having a molecular weight of 3750 and a p/q ratio of 0.7, synthetized by stoichiometric reaction, at 150° C. in a nitrogen atmosphere, from the corresponding methyl diester and from 3,4-diaminobenzotrifluorine.

After mixing in the arm-mixer, the resulting pasty suspension was passed on the triple roll mill, thus obtaining, after the third run, a grease having a penetration of 240 mm/10 (ASTM D 1403, ½ scale).

After a mechanical 10,000-stroke working, the penetration was of 250 mm/10, which revealed a high mechanical stability. The diameter of the trace left by wear on the Shell 4-ball machine at 50° C. (ASTM D 2266) was equal to 1.1 mm.

By carrying out the IP 239 test on a Shell 4-ball machine, a welding load of 650 kg was measured, which proved an excellent wear-resisting behavior of the grease when used under very high loads.

EXAMPLE 5

The same apparatus and the same preparation procedures as described in example 1 were employed.

The grease was formulated starting from:

6.5 kg of polytetrafluoroethylene
9.5 l of the polyether indicated in example 4
14 g of surfactant of formula $$NaOOCCF_2O(C_2F_4O)_2(CF_2O)_2CF_2COONa$$

14 g of phosphine of formula

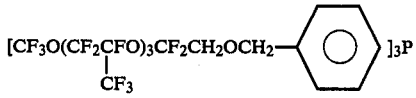

prepared starting from potassium alcoholate.

$CF_3O\ (C_3F_6O)_3\ CF_2CH_2OK$ reacted with p.bromobenzylchloride at room temperature, thus obtaining the derivative having a bromobenzene thermal group. The latter was reacted with Li-butyl thus substituting bromine by Li, whereupon the Li-phenyl derivative was lastly reacted with $PCl_3$.

After mixing in the arm-mixer and milling in the triple roll mill, a grease having a penetration of 250 mm/10 (ASTM D 1403, ½ scale) was obtained.

Such grease, subjected to the IP 239 test on a 4-ball Shell machine, exhibited a welding load equal to 800 kg, which revealed an excellent wear-resisting behavior under very high pressure conditions.

EXAMPLE 6

The same apparatus and the preparation modalities as in example 1 were employed.

The grease was formulated starting from:

6.5 kg of polytetrafluoroethylene
9.5 l of the polyether indicated in example 4
14 g of a surfactant of formula:

$$NaOOCCF_2O(C_2F_4O)_2(CF_2O)_2CF_2COONa$$

16 g of phosphonic derivative of formula

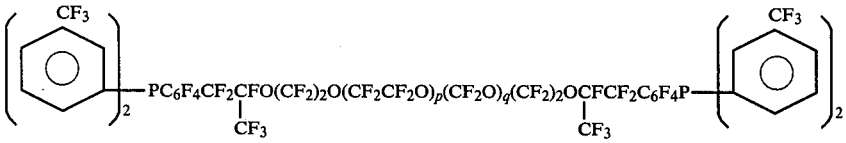

having a molecular weight=4750 and wherein $p/q=0.7$, prepared starting from

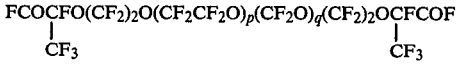

(in its turn obtained from $FOCCF_2O(CF_2CF_2O)_p(CF_2O)_qCF_2COF$ by sum of 2 moles of

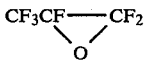

in the presence of CsF) by condensation on copper-bromotetraflurophenyl, fluorination with $SF_4$ in the presence of anhydrous HF, substitution of bromine by lithium and reaction with chloro-bis(trifluoromethyl-phenyl)-phospine.

After mixing in the arm-mixer and milling in the triple roll mill, a grease having a penetration of 250 mm/10 (ASTM D 1403, ½ scale) was obtained.

Such grease exhibited, when subjected to the IP 239 test on a Shell 4-ball machine, a welding load equal to 800 kg, which provided a wear-resisting behavior under conditions of very high pressure.

To evaluate the anticorrosive effect and the high stability as well as chemical inertia of the grease obtained, a sample thereof was treated with oxygen at 232° C. in the presence of ferrous metal laminae (steel laminae).

Negligible weight variations of the laminae and of the grease were found, in opposition to what happens in the absence of the phosphine derivative.

EXAMPLE 7

The same apparatus and preparation modalities of example 1 were employed.

The grease was formulated starting from:

6.5 kg of polytetrafluoroethylene 9.5 l of the polyether indicated in example 1

14 g of a surfactant of formula:

$$NaOOCCF_2O(C_2F_4O)_2(CF_2O)_2CF_2COONa$$

16 g of the phospho-sym.triazine derivative of formula:

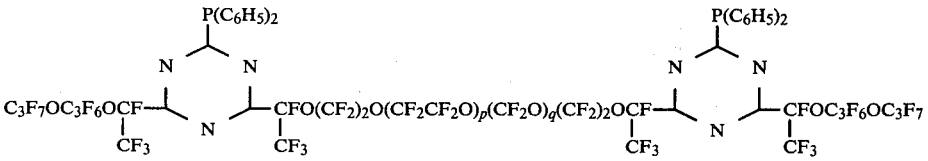

having a molecular weight=4880 and wherein p/q=0.7 and prepared starting from

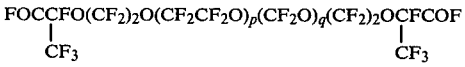

obtained as in example 6 and reacted with $NH_3$ and then with $P_2O_5$ to obtain the corresponding dinitrile, which, by reaction, at low temperature and at atmospheric pressure, with liquid $NH_3$, provided the diamine which, with an excess of nitrile of formula

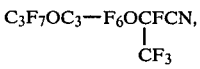

yielded imidoylamidine; the latter, with diphenyltrichloro-phosphorane $PCl_3(CH_6H_5)_2$, provided the product specified hereinbefore.

After a mechanical 10,000-stroke working, the penetration was of 250 mm/10, which revealed a high mechanical stability. The diameter of the trace left by wear on the Shell 4-ball machine at 50° C. (ASTM D 2266) was equal to 1.1 mm.)

By carrying out the IP 239 test on the Shell 4-ball apparatus, a welding load of 650 kg was measured, which revealed an excellent wear-resisting behavior of the grease under conditions of very high pressure.

A grease sample was treated with oxygen at 232° C. in the presence of ferrous metal (steel) laminae. The volatile product formed (determined on the basis of the weight loss) was in an amount of 1/50 of the one formed by treating an analogous grease sample not containing the phosphotriazine compound.

The lubricating composition obtained according to this example caused neither the rusting of the ferrous metals under mild temperature conditions and at a high moisture degree (ASTM D 1748/70 test), nor the rusting under high temperature conditions. A lubricating grease sample quite similar, but free from the phosphotriazine compound was subjected to the same tests: both rusting and corrosion of the metal specimens were noticed.

EXAMPLE 8

The same apparatus as described in example 1 was used.

7 kg of a polytetrafluoroethylene of the same type as the one described in example 1 were introduced into the mixer, were degassed at 50° C. under a vacuum of $5.10^{-2}$ torr and were additioned with 9 l of Halocarbon oil 14-25 (trade-mark of Halocarbon Products Corp., United States), a low molecular weight polymer of chlorotrifluoroethylene, having a viscosity of 1,000 cs (100° F.), and additioned with 14 g of a surfactant of formula $$NaOCOCF_2(CF_2CF_2O)_2(CF_2O)_2CF_2COONa$$

previously deaerated at 50° C. under a vacuum of $4.10^{-2}$ torr. The suspension was homogenized by stirring for 3 hours while the temperature was allowed to decrease to 20° C.; a pasty suspension was thus obtained, which was worked on the triple roll mill by passing it 4 times between the rolls, each time for 2 hours, and keeping the rolls in contact with one another under a servofluid pressure of 30 atm.

After each run, the following penetration values (ASTM D 1403, ½ scale) were obtained:

after the 1st run: 242 mm/10 after the 2nd run: 238 mm/10 after the 3rd run: 236 mm/10 after the 4th run: 236 mm/10.

On a grease sample, which had undergone the mechanical 10,000-stroke working, a penetration of 238 (mm/10, corresponding to a high mechanical stability, was measured. On a grease sample, after separation of the oil by means of 1,1,2-trifluorotrichloroethane, the particles of thickening polytetrafluoroethylene were examined under the transmission electron microscope: a particle size distribution ranging from 0.1 to 0.4 microns was determined. The particles exhibited a rounded shape.

Grease samples were subjected to the measurements listed hereinbelow:

Oil separation, method FTMS 791-321 (100° C., 30 hours): 4.1%

Consistency (ASTM D 1403, ½ scale, 25° C.) after the Roll test (ASTM D 1831, 100° C.):
penetration after 4 hours: +0.8%
penetration after 8 hours: +4%

Diameter (ϕ) of the trace left by wear on the Shell 4-ball machine (ASTM D 2266):
means ϕ of the trace left by wear at 50° C: 1.5 mm
means ϕ of the trace left by wear at 120° C.: 1.6 mm wearing load on the Shell 4-ball machine (IP 239 method, spindle speed=1460 rpm): 590 kg.

What we claim is:

1. A process for preparing a lubricating grease based on polytetrafluoroethylene and on a liquid dispersant selected from the group consisting of the oligomers of trifluorochloroethylene and the perfluoropolyethers, comprising the following working steps:

(a) heating, under reduced pressure, a polytetrafluoroethylene having a molecular weight of from 500,000 to 1,000,000, consisting of particles of the aggregated type, to remove air and volatile products;

(b) heating, under reduced pressure, a compound selected from the group consisting of oligomers of trifluorochloroethylene having a viscosity, at 20° C., of from 100 to 1,000 cst and perfluoropolyethers belonging to the classes of general formulae:

$$X—O—(C_3F_6O)_M(CF_2O)_n—Y \quad (I)$$

$$A—O—(C_2F_4O)_p(CF_2O)_q—B \quad (II)$$
$$A—O—(C_2F_4O)_r(CF_2O)_s(C_tF_{2t}O)_u—B \quad (III)$$

wherein: X and Y are a terminal group $—CF_3$ or $—C_2F_5$, m and n are integers, m+n=10–100, m/n=10–50, A and B are terminal groups $—CF_3$, $—C_2F_5$, $—CF_2Cl$, $—CF_2CF_2Cl$, p and q are integers, p+q=10–200, p/q=0.1–10, r+s+u=10–3,000, $$\frac{u}{r+s} = 0.01\text{–}0.3,$$

r/s=0.1–10, t≅3, and having a viscosity, at 20° C., ranging from 20 to 4,000 cs if belonging to class (I) from 50 to 6,000 cs if belonging to class (II) and from 40 to 30,000 cs if belonging to class (III), and with a perfluorinated surfactant of the anionic type, characterized by a perfluoroalkylene chain or by a perfluorooxyalkylene chain, (c) mixing, under reduced pressure, the polytetrafluoroethylene coming from step (a) with the oligomer of trifluorochloroethylene or the perfluoropolyether containing the perfluorinated surfactant, coming from step (b), to obtain a mix containing from 15 to 40% by weight of polytetrafluoroethylene, from 60% to 85% by weight of oligomer of trifluorochloroethylene or perfluoropolyether, and from 0.1% to 0.4% by weight of surfactant.

2. The process according to claim 1 in which the perfluoropolyether employed has a viscosity at 20° C. ranging from 40 to 1600 cs, if belonging to class (I), from 60 to 6000 cs if belonging to class (II) and from 60 to 28,000 cs if belonging to class (III).

3. The process according to claim 1 or 2, in which there is added to the mixture of the components a stabilizing and corrosion-preventing agent selected from the group consisting of:

(a) fluorinated bis-benzimidazoles of formula:

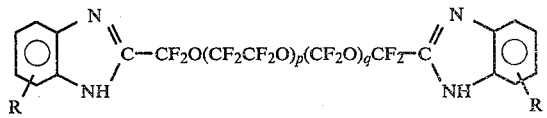

wherein R is selected from the group consisting of F and $CF_3$, the sum p+q=10–100, the ratio p/q=0.1–2, (b) esters of phosphorous acid with a perfluoroalkoxy-alcohol, (c) perfluoropolyethers with at least one phosphinic end group, and (d) perfluoropolyethers with perfluoropolyoxyperfluoroalkyl-substituted phosphotriazinic groups.

4. The process according to claim 1, in which, as perfluorinated surfactant of the anionic type, there is employed a compound selected from the group consisting of compounds having the general formula:

$$CF_3—(CF_2)_n—D \quad (1)$$

wherein n is an integer from 2 to 12, and D is selected from the group consisting of —COOM, $—SO_3M$ and $—O—C_2F_4SO_3M$ in which M is a cation selected from the group consisting of Na, K, ½ Ba and ½ Ca, and compounds having the general formula:

$$R—O—(C_3F_6O)_i—(C_2F_4O)_k—(CF_2O)_h—Q \quad (2)$$

wherein R is either like or unlike Q and is selected from the group consisting of $CF_3$— and $MOCOCF_2$—, and Q is a $—CF_2COOM$ group wherein M is a cation as in formula (1), i and k are equal to zero or are integers from 1 to 7, provided that, when R is equal to zero, h is an integer from 1 to 7, and the sum i+k+h is an integer from 2 to 10.

5. The process of claim 4, in which n is formula (1) is an integer from 3 to 7.

6. The process of claim 1 in which, in formula (2), the sum i+k+h is an integer from 2 to 6.

* * * * *